US011794934B2

(12) United States Patent
Peebles

(10) Patent No.: US 11,794,934 B2
(45) Date of Patent: Oct. 24, 2023

(54) ADJUSTABLE CARTONER INFEED BUCKET AND ASSOCIATED CARTONER

(71) Applicant: Bartelt Packaging LLC, Covington, KY (US)

(72) Inventor: Donald Scott Peebles, Bradenton, FL (US)

(73) Assignee: BARTELT PACKAGING LLC, Sarasota, FL (US)

( * ) Notice: Subject to any disclaimer, the term of this patent is extended or adjusted under 35 U.S.C. 154(b) by 0 days.

(21) Appl. No.: 17/538,116

(22) Filed: Nov. 30, 2021

(65) Prior Publication Data

US 2022/0332451 A1 Oct. 20, 2022

Related U.S. Application Data

(60) Provisional application No. 63/177,154, filed on Apr. 20, 2021.

(51) Int. Cl.
*B65B 35/40* (2006.01)
*B65B 59/00* (2006.01)
*B65B 5/10* (2006.01)

(52) U.S. Cl.
CPC ..... *B65B 35/405* (2013.01); *B65B 5/106* (2013.01); *B65B 59/005* (2013.01)

(58) Field of Classification Search
USPC ..... 53/244
See application file for complete search history.

(56) References Cited

U.S. PATENT DOCUMENTS

| | | | | |
|---|---|---|---|---|
| 4,254,604 | A | 3/1981 | Vogel | |
| 5,185,984 | A * | 2/1993 | Tisma | B65B 59/001 53/566 |
| 5,241,806 | A | 9/1993 | Ziegler | |
| 5,561,968 | A | 10/1996 | Palmer | |
| 5,787,680 | A | 8/1998 | Tisma | |
| 6,711,878 | B1 | 3/2004 | Paselsky | |
| 6,725,629 | B2 | 4/2004 | Pearce | |
| 7,621,109 | B2 | 11/2009 | Momich | |
| 7,658,054 | B2 | 2/2010 | Veix | |
| 2004/0065057 | A1 * | 4/2004 | Momich | B65B 35/205 53/473 |
| 2007/0245689 | A1 * | 10/2007 | Lubezny | B65B 59/005 53/235 |

OTHER PUBLICATIONS

Admitted Prior Art—Cartoner Infeed Bucket With Spring-Biased Wall, one page.

* cited by examiner

*Primary Examiner* — Chinyere J Rushing-Tucker
(74) *Attorney, Agent, or Firm* — THOMPSON HINE LLP

(57) ABSTRACT

A cartoner infeed bucket includes a bottom wall, a first end wall extending upward from the bottom wall and a second end wall extending upward from the bottom wall and spaced apart from the first end wall to define an item carrying space, the second end wall running substantially parallel to the first end wall. The second end wall is mounted for adjustable movement along the bottom wall so as to vary a spacing between the first end wall and the second end wall and/or the first end wall is mounted for pivotable movement relative to the bottom wall.

19 Claims, 11 Drawing Sheets

ADJUSTABLE CARTONER INFEED BUCKET AND ASSOCIATED CARTONER

TECHNICAL FIELD

This application relates generally to horizontal cartoner machines and, more specifically, to an adjustable cartoner infeed bucket for use in such cartoners.

BACKGROUND

In the packaging of items, horizontal cartoners carry a series of buckets along a path that includes one or more load stations at which items are loaded into a space between leading and trailing end walls of the bucket and one or more unload stations in which the items are pushed laterally out of the bucket into an opening of a carton. Such cartoners can be used to fill different sizes of cartons with different product sizes/counts. However, in order to do so, typically one set of cartoner buckets must be removed and replaced with a set of different size buckets. This changeover requires substantial time, and the need for various bucket sizes undesirably takes up facility storage space. In addition, current buckets typically have end walls that are fixed and vertical, which does not facilitate item insertion down into the buckets at the load stations. Buckets that have one tiltable wall that is spring biased into an upright position also exist, which requires the wall to be held in the angled position, against the force of the biasing spring, at all times when it is desired to have the bucket wall in the angled position.

Accordingly, it would be desirable to provide a cartoner infeed bucket that is adjustable to facilitate loading of various carton sizes and/or that includes an end wall that can be easily reoriented for the purpose of item loading.

SUMMARY

In one aspect, a cartoner infeed bucket includes a bottom wall, a first end wall extending upward from the bottom wall and a second end wall extending upward from the bottom wall and spaced apart from the first end wall to define an item carrying space. The second end wall is mounted for adjustable movement along the bottom wall so as to vary a spacing between the first end wall and the second end wall.

In another aspect, a cartoner infeed bucket includes a bottom wall, a first end wall extending upward from the bottom wall and a second end wall extending upward from the bottom wall and spaced apart from the first end wall to define an item carrying space, the second end wall running substantially parallel to the first end wall. The first end wall is pivotably mounted to the bottom wall for movement between an upright position running substantially vertically up from the bottom wall and an angled position running upward and outward from the bottom wall, wherein a magnetic catch assembly is associated with the first end wall to releasably retain the first end wall in the upright position and to releasably retain the first end wall in the angled position.

In a further aspect, a cartoner infeed bucket includes a bottom wall, a first end wall extending upward from the bottom wall and a second end wall extending upward from the bottom wall and spaced apart from the first end wall to define an item carrying space. The first end wall is pivotably mounted to the bottom wall for movement between an upright position running substantially vertically up from the bottom wall and an angled position running upward and outward from the bottom wall, wherein a magnetic catch assembly is associated with the first end wall to releasably retain the first end wall in the upright position and to releasably retain the first end wall in the angled position.

The details of one or more embodiments are set forth in the accompanying drawings and the description below. Other features, items, and advantages will be apparent from the description and drawings, and from the claims.

DETAILED DESCRIPTION

Figure 1:
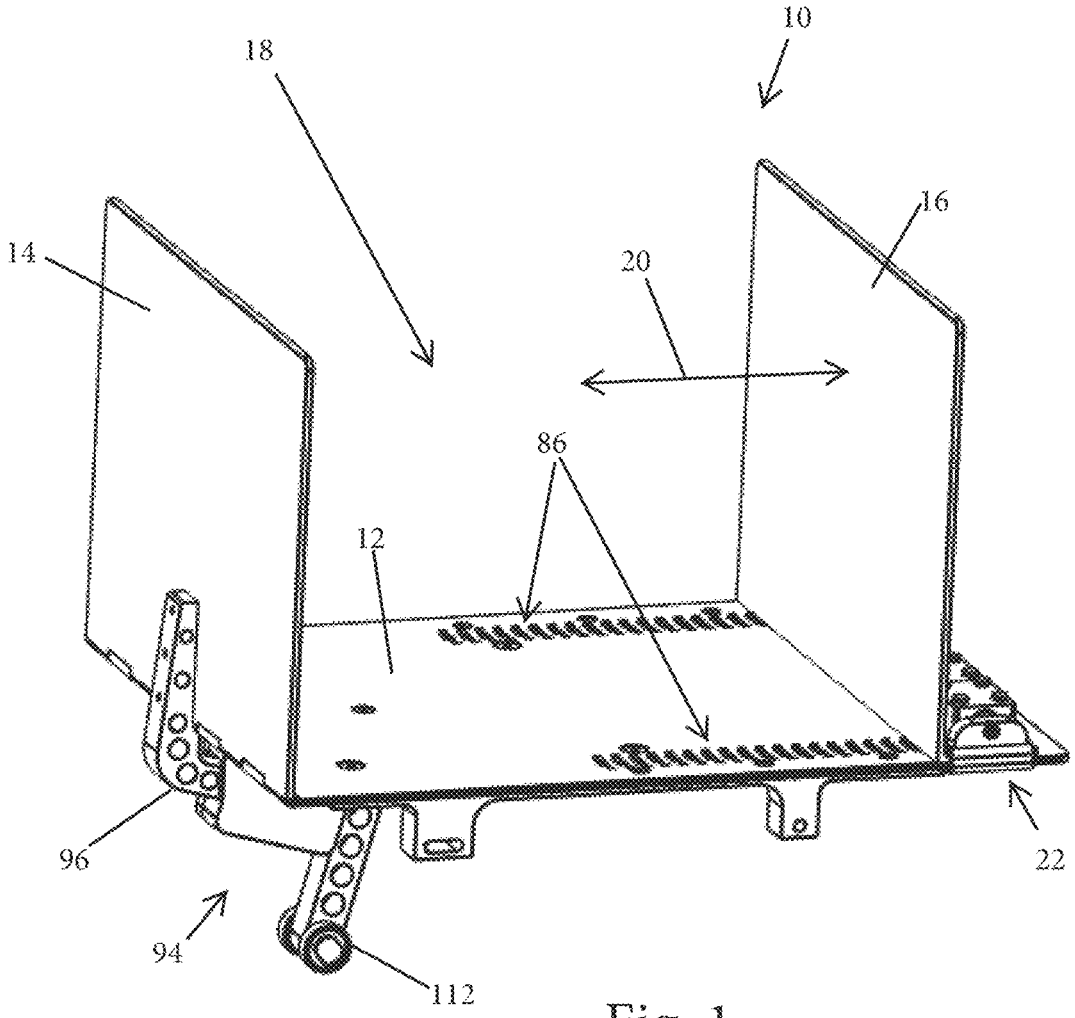
FIGS. 1-2 are perspective views of one embodiment of a cartoner infeed bucket.
Figure 2:
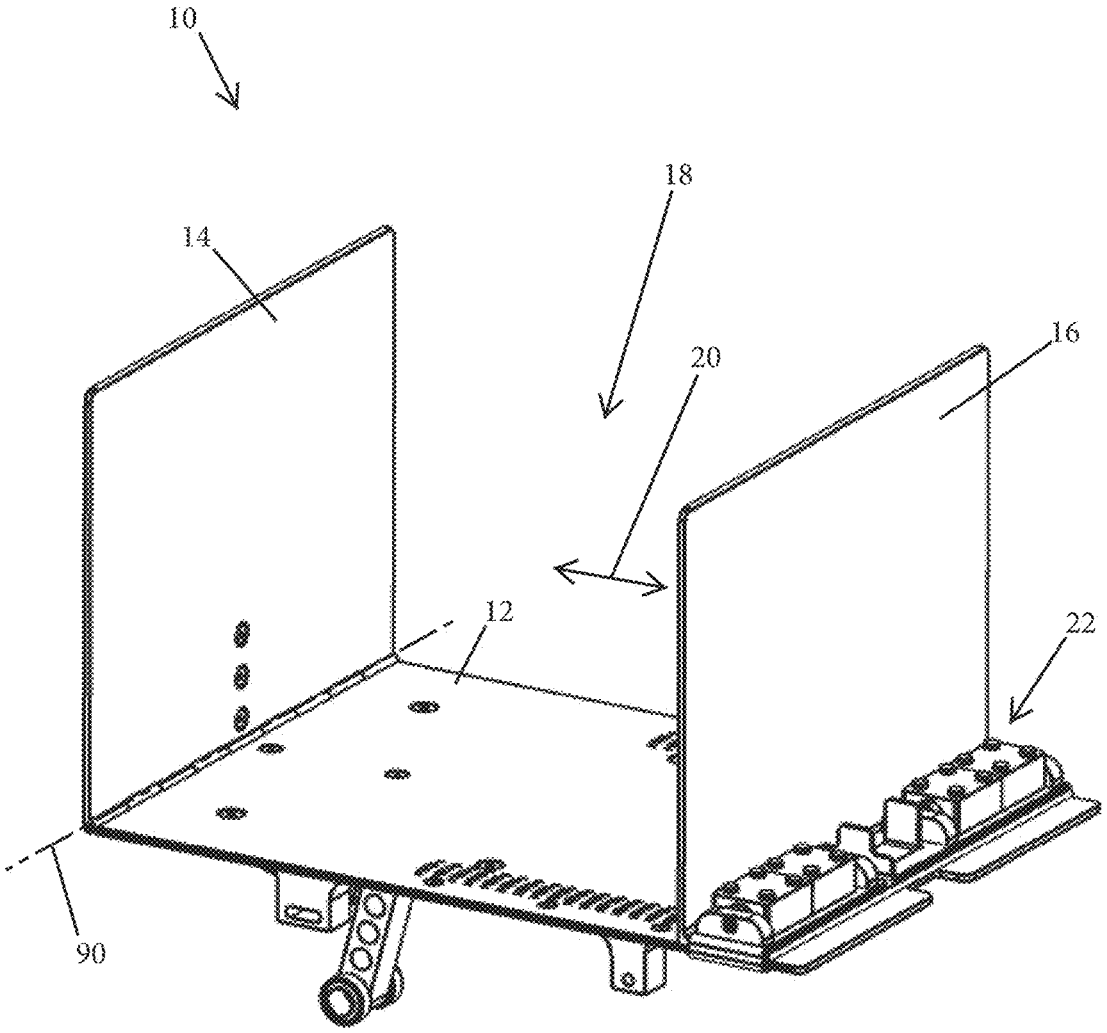

Referring FIGS. 1-10, a cartoner infeed bucket 10 includes a bottom wall 12, a leading end wall 16 extending upward from the bottom wall and a trailing end wall 14 extending upward from the bottom wall. The two walls run substantially parallel to each other and are spaced apart to define an item carrying space 18 therebetween.

The leading end wall 16 is mounted for adjustable movement along the bottom wall (e.g., per arrow 20) so as to vary the spacing between the two walls 14 and 16. In order to achieve the adjustable position, an adjustment mechanism, here in the form of a clamp assembly 22, is provided to mount the leading end wall 16 to the bottom wall 12. The clamp assembly 22 is movable between the illustrated closed position to hold the leading end wall 16 at one location with one spacing from the trailing end wall 14 and an open position to allow the leading end wall to be shifted to a different location with a different spacing from the trailing end wall 14.

Figure 3:
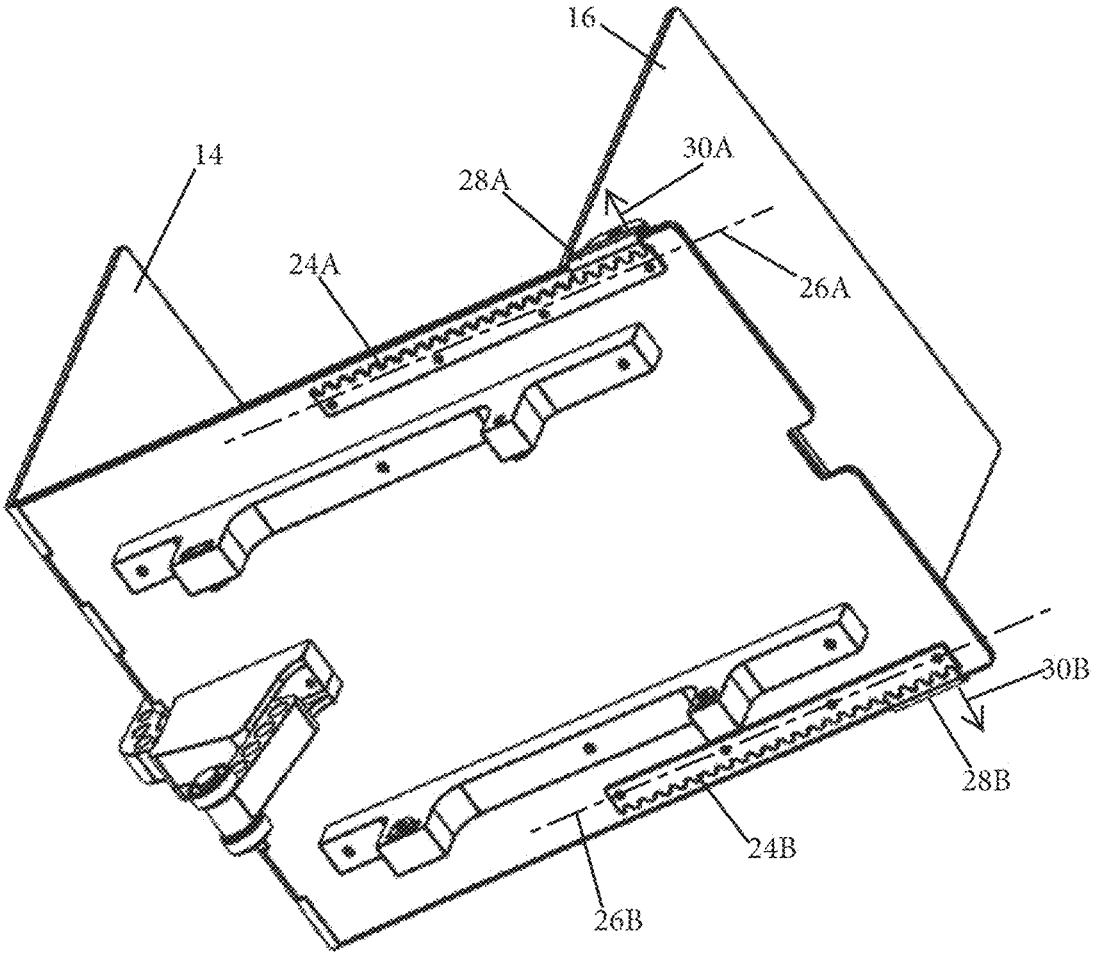
FIG. 3 is a bottom perspective view of the cartoner infeed bucket.
Figure 4:
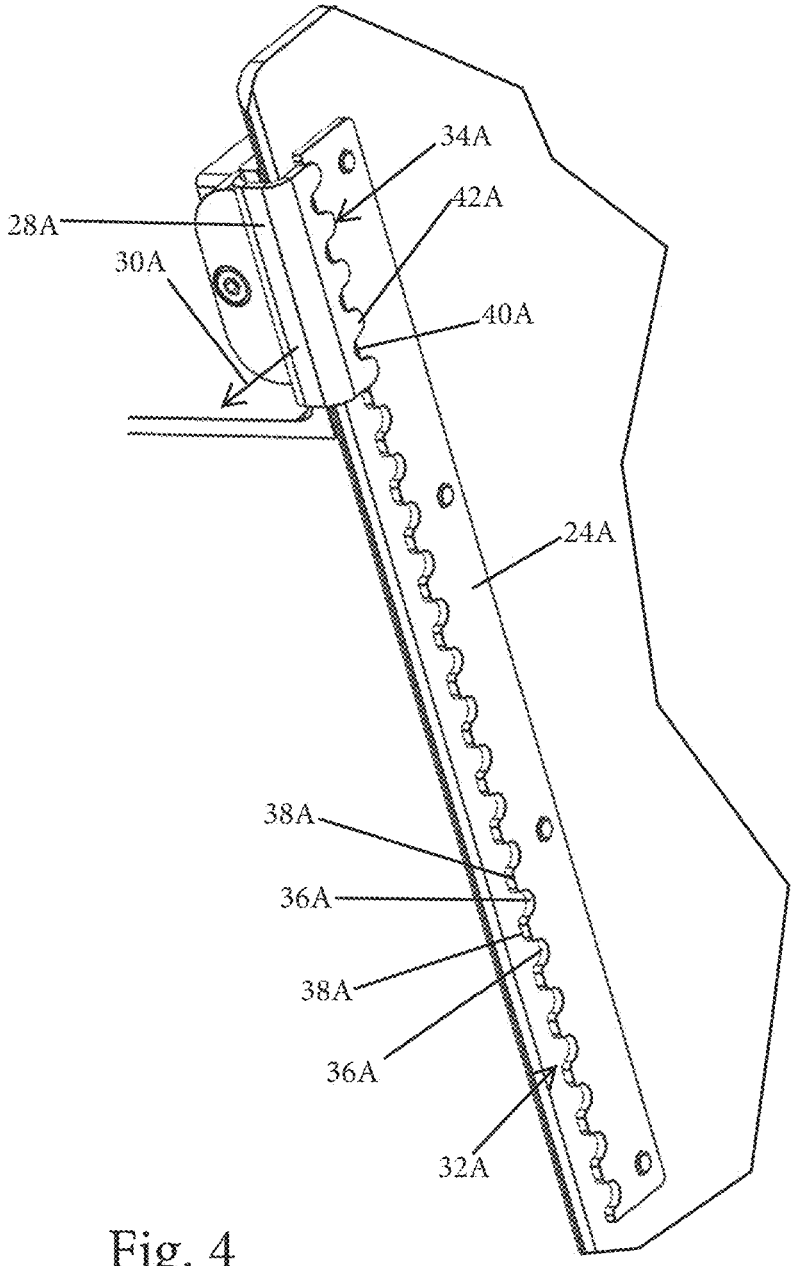
FIG. 4 is a partial perspective view of a clamp and rail.
Figure 5:
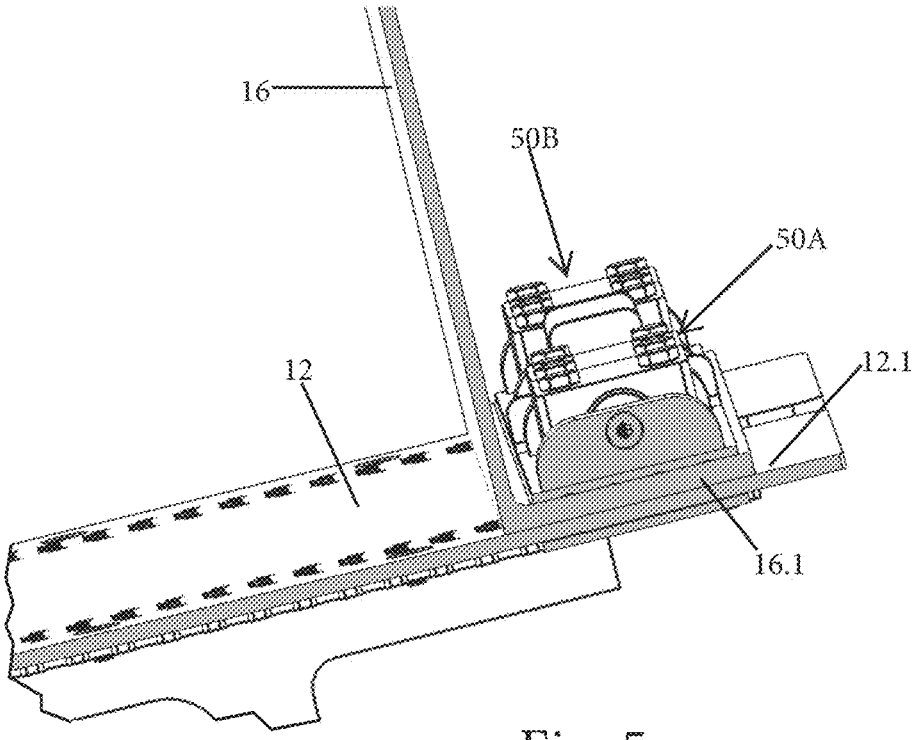
FIG. 5 is a partial cross-section of trailing end wall to bottom wall interconnection.
Figure 6:
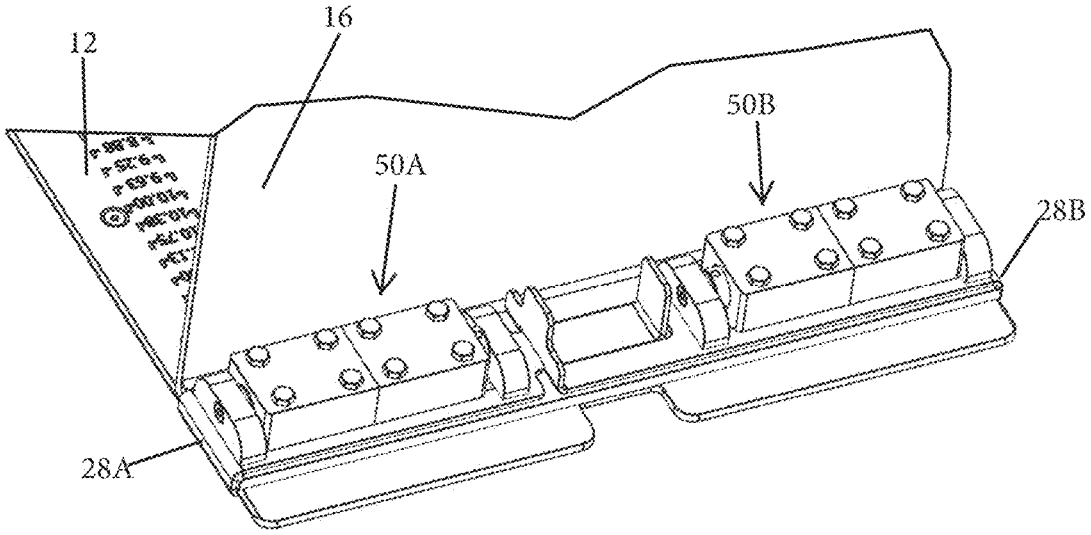
FIG. 6 is a perspective view of biasing assemblies associated with the trailing end wall.
Figure 7:
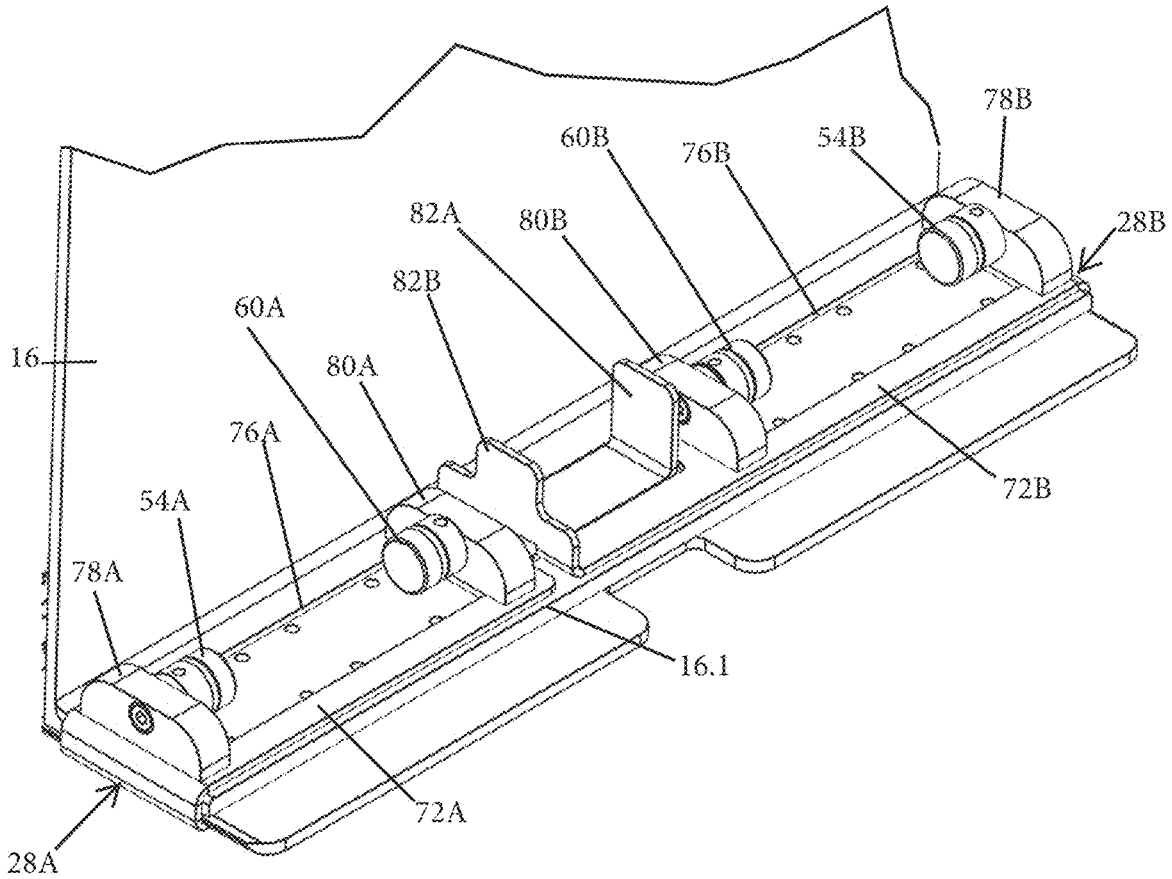
FIG. 7 is a perspective view with portions of the biasing assemblies not shown.
Figure 8:
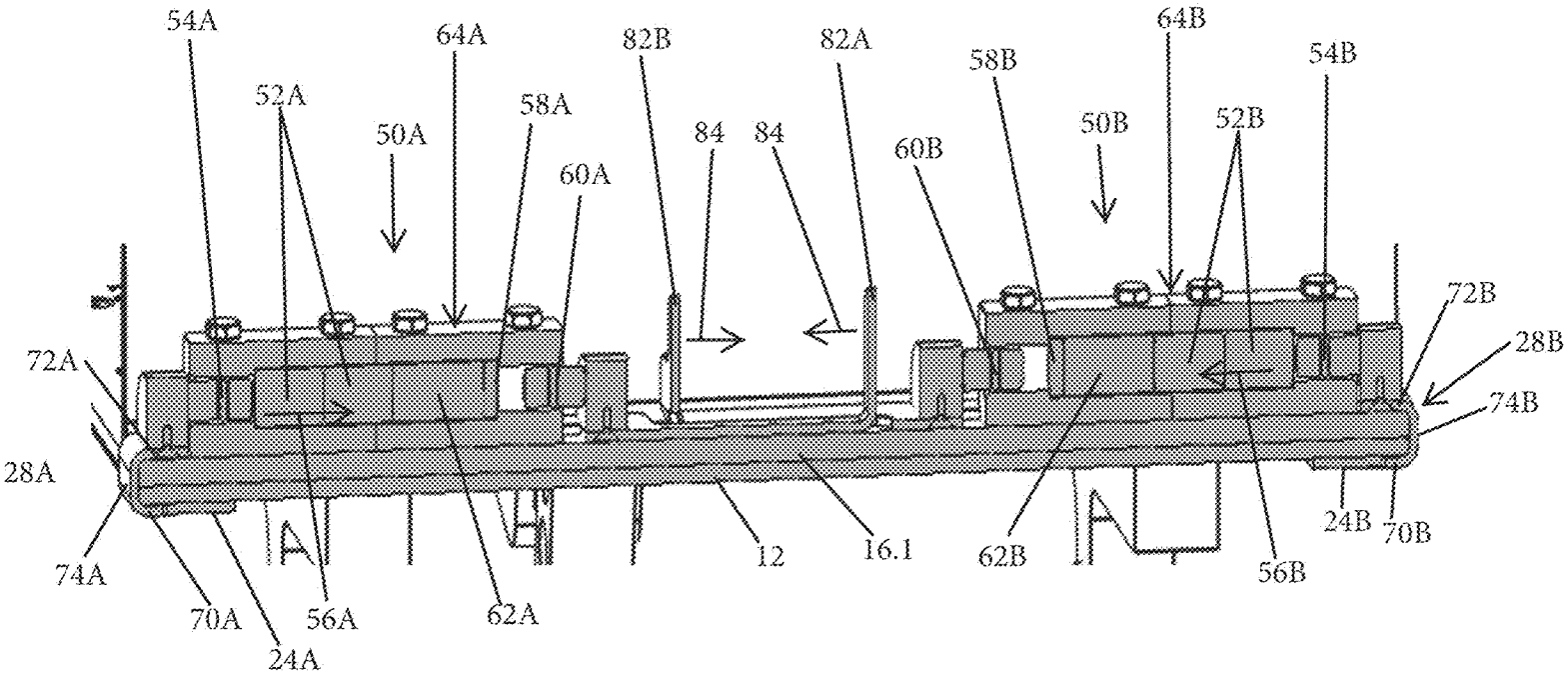
FIG. 8 is a cross-section through the biasing assemblies.

As seen in FIG. 3, the clamp assembly includes a set of rails 24A, 24B having lengths extending along the bottom wall 12 along axes 26A, 26B that run between the end walls (here, the axes run perpendicular to the planes in which the end walls lie), and clamps 28A, 28B connected to the leading end wall 16. Each clamp 28A, 28B is movable between the illustrated closed position in engagement with its respective rail 24A, 24B to hold the leading end wall against movement along the length of the rail, and an open position (e.g., shifted laterally outward per arrows 30A, 30B) in which the clamp releases from the rail by an amount sufficient to allow the leading end wall 16 to move along the length of the rail.

Referring now to rail 24A and clamp 28A only, it is understood that the following description applies equally to rail 24B and clamp 28B. Per FIG. 4, the rail 24A includes a plurality of mating features 32A along at least part of its length, and the clamp 28A includes at least one (here a plurality of) corresponding mating feature(s) 34A configured for engagement with the mating features 32A. Generally, here the mating features 32A are formed by alternating slots 36A and teeth 38A, and the mating features 34A are formed by similarly shaped alternating slots 40A and teeth 42A. In the illustrated embodiment, the teeth and slots together form scalloped serrations. However, other teeth/slot shapes are possible, such as triangular or trapezoidal or semicircular. Moreover, other variations of mating features are possible. For example, the mating features on each rail could be formed as holes in a side edge of the rail and the mating feature(s) on each clamp could be formed as a pin or pins to engage in the holes.

Referring again to the clamps collectively, each clamp 28A, 28B is connected to the leading end wall 16 via a respective biasing assembly 50A, 50B for holding the clamp in the closed position. In this regard, a seating flange 16.1 extends at one side from the bottom of the end wall 16 and rests atop the upper surface 12.1 of the bottom wall 12 to provide stability for the end wall 16. Each biasing assembly 50A, 50B is mounted atop the seating flange 16.1 and includes at least one magnet 52A, 52B (here two for each) for inhibiting movement of the respective clamp 28A, 28B away from the closed position. In this regard, the magnets 52A, 52B interact with and magnetically attracted steel striker plates 54A, 54B to urge the clamps inward (per arrows 56A, 56B). Each biasing assembly also includes at least one further magnet 58A, 58B for holding the clamps in the open position. In this regard, when each clamp 28A, 28B is manually shifted outward (in the directions opposite arrows 56A, 56B), each magnet 58A, 58B interacts with a respective steel striker plate 60A, 60B to urge the clamps outward (opposite arrows 56A, 56B) for holding the clamps in their open positions. Thus, each biasing assembly operates as a dual biasing assembly capable of providing bias toward either the closed position or the open position of the clamp, depending upon the clamp position.

The magnets 52A and 58A, along with a plastic spacer 62A therebetween, are held in fixed positions within a housing 64A that mounts to the upper surface of the seating flange 16.1. Likewise, the magnets 52B and 58B, along with a plastic spacer 62B therebetween, are held in fixed positions within a housing 64B that mounts to the upper surface of the seating flange. The striker plates 54A and 60A are mounted to the clamp 28A for movement therewith, and the striker plates 54B and 60B are mounted to the clamp 28B for movement therewith. In this regard, each clamp 28A, 28B includes a lower segment 70A, 70B that interacts with the rail, an upper segment 72A, 72B that slides along the upper surface of the seating flange 16.1 and a connecting segment 74A, 74B between the upper and lower segments and wrapping around the edges of the seating flange and the bottom wall. Each upper segment 72A, 72B has a cutout slot 76A, 76B that enables the upper segment to slide relative to the housing 64A, 64B, a mount 78A,78B for the striker plate 54A, 54B and a mount 80A, 80B for the striker plate 60A, 60B. The striker plates, with associated surrounding structure, project into end openings in the housings to facilitate magnetic interaction with the magnets.

For the purpose of adjustment of the position of the leading end wall 16, each upper segment 72A, 72B includes an upwardly extending tab 82A, 82B. The upper segments and tabs are positioned and configured such that squeezing the tabs 82A, 82B toward each other, per arrows 84, causes clamps to slide outward so that the lower segments disengage from the rails. The wall 16 can then be shifted to a new position along the bottom wall, and the tabs 82A, 82B pushed away from each other to reengage the clamping of the rails. The tabs 82A, 82B may be positioned a distance from each other that facilitates single-hand operation (e.g., squeezing together with thumb and pointer finger when the clamps are closed). Notably, the bottom wall 12 may include a measurement scale 86, or other markings, along its upper surface to facilitate an operator finding and setting the proper end wall position for a given carton size.

With respect to the magnets 52A, 52B and 60A, 60B, the magnets 52A, 52B are magnetically stronger than the thinner magnets 60A, 60B, so as to provide a stronger magnetic biasing force to hold the clamps in the closed positions, as compared to the magnetic biasing force that holds the clamps in the open positions.

Other types of clamping assemblies and biasing could be used. For example, spring-biased clamps could be used, in which the clamps are only biased in the closed positions and (i) must be manually held in the open positions during adjustment of the trailing end wall position or (ii) have associated latches that can be used to temporarily retain the clamps in the open positions during wall position adjustment.

Figure 9:
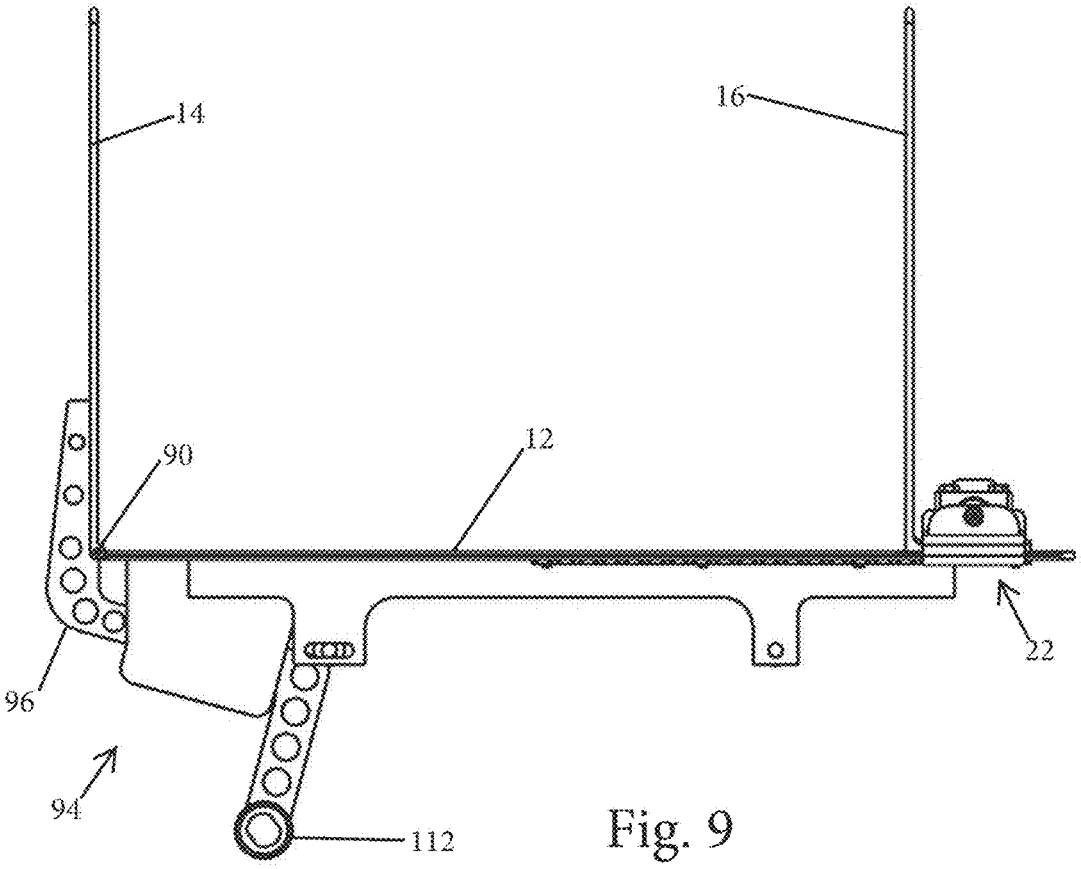
FIGS. 9 and 10 are side views.
Figure 10:
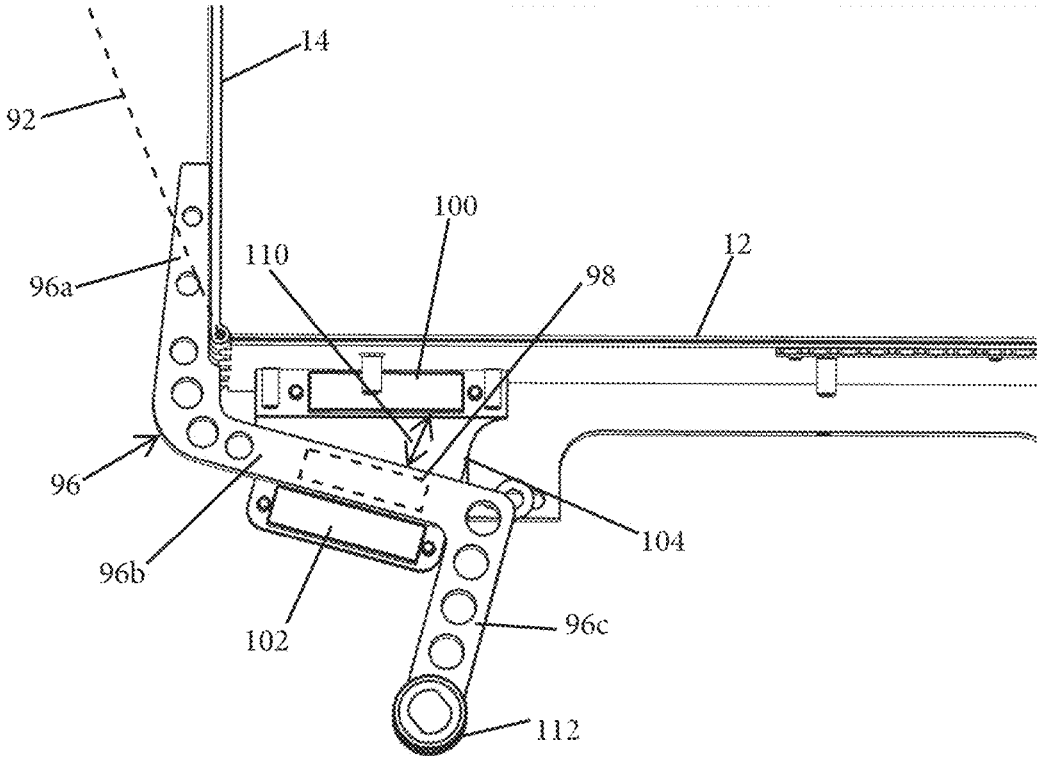

Referring now to FIGS. 9-10, the trailing end wall 14 is pivotably mounted to the bottom wall 12, per pivot axis 90, for movement between the illustrated upright position, running substantially vertically up from the bottom wall 12, and an angled position (represented by the dashed line 92 in FIG. 10) running upward and outward from the bottom wall 12. Here, the upright position is a position in which the trailing end wall 14 is substantially parallel to the leading end wall. A magnetic catch assembly 94 is associated with the trailing end wall 14 to releasably retain the end wall 14 in the upright position and to releasably retain the end wall 14 in the angled position. Here, the magnetic catch assembly 94 includes an actuator arm 96 connected, by arm segment 96*a*, to the end wall 14 so as to pivot with the end wall 14, and a magnet 98, carried on arm segment 96*b*. A magnet 102 is mounted at a location (e.g., stationary on the bucket) to interact with the magnet 98 so as to releasably retain the end wall 14 in the upright position, and a magnet 100 is mounted at a location (e.g., stationary on the bucket) to interact with the magnet 98 so as to releasably retain the end wall 14 in the angled position. Here, a bracket 104 is mounted at an underside of the bottom wall 12, magnet 100 is mounted to an upper portion of the bracket and magnet 102 is mounted to a lower portion of the bracket. Actuator arm segment 96*b* extends within a space between the magnets 100 and 102 to facilitate position adjustment and for magnetic attraction and retention of magnet 98 toward whichever magnet 100, 102 is adjacent (depending upon upright or angled position of the end wall 14 and corresponding position shift of the arm segment 96*b*, with movement of arm segment 96*b* represented by arrow 110).

The actuator arm 96 also includes a lower segment 96*c* having an associated cam roller 112 configured for interacting with a cam track to shift the end wall 14 between the upright and angled positions.

Figure 11:
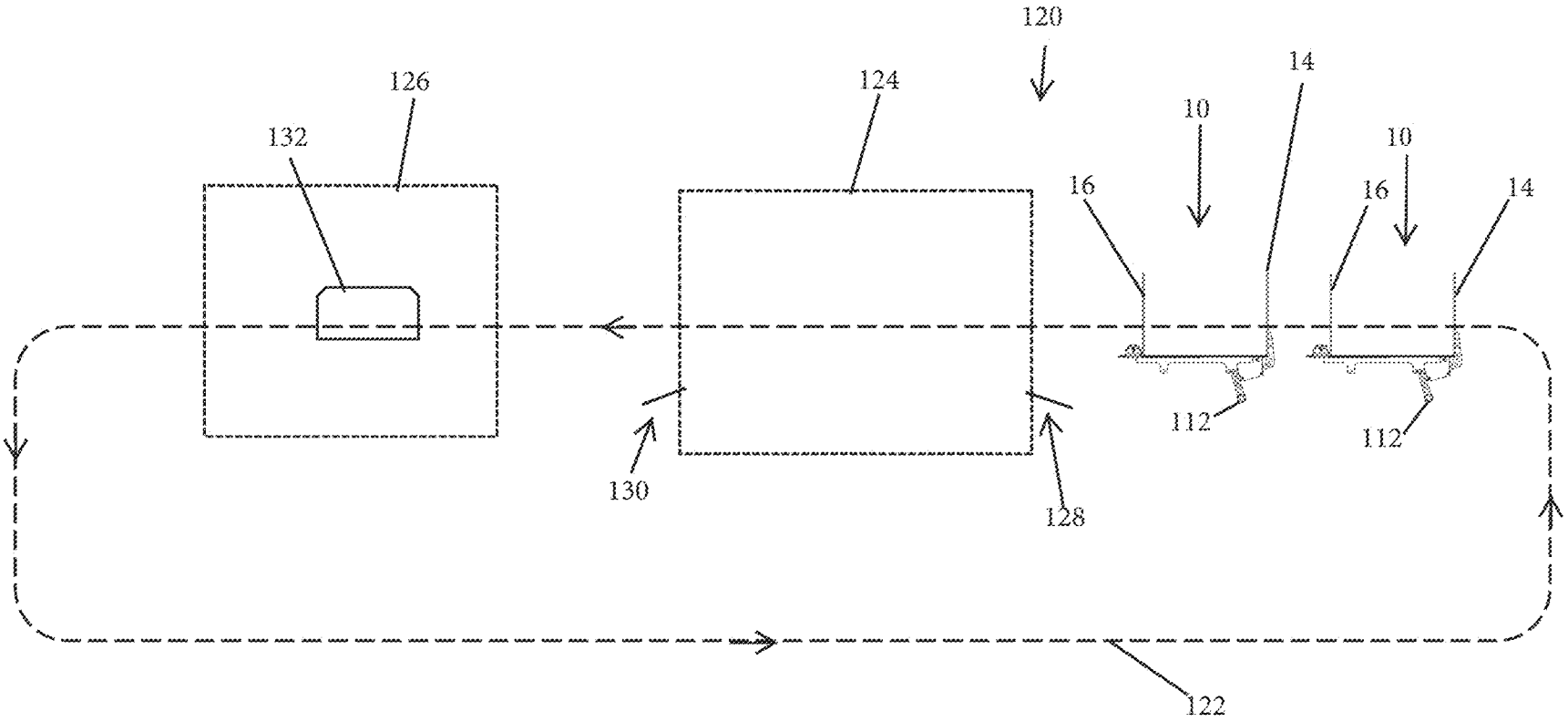
FIG. 11 is a schematic depiction of a cartoner machine incorporating the cartoner infeed buckets.

Referring to FIG. 11, showing a schematic depiction of a cartoner machine 120, a plurality cartoner infeed buckets 10 are carried by a conveyor (shown as dashed line 122) that carries the cartoner infeed buckets 10 past a loading station 124 and a unloading station 126. As the buckets 10 approach the loading station 124, a cam track segment 128 below the buckets interacts with the bucket cam roller (e.g., roller interacts with upper surface of the cam segment 128) to kick the trailing end wall 14 from the upright orientation to the angled orientation, which facilitates loading of the buckets from the top. In one implementation, the cam segment 128 could, for example, be a cam slot with funnel-shaped opening having a height dimension that is sufficient to receive the cam roller regardless of whether the end wall 14 is upright or angled, in order to prevent any jams caused by buckets in which the end wall 14 has been inadvertently been shifted to the angled position prior to reaching the cam slot. As the buckets leave the loading station 124, another cam track segment 130 interacts with the bucket cam roller (e.g., cam roller interacts with lower surface of the segment 130) to kick the trailing end wall 14 back into the upright orientation. In both orientations, the end wall 14 is held in place by the interaction of the magnets as described above. When the loaded buckets 10 reach the unloading station 126, an unloader, such as a pusher plate 132 that moves laterally between the end walls 14 and 16 (e.g., here into the page) pushes the items within the bucket into a side opening of an aligned carton that is alongside the conveyor 122. The empty buckets are then returned to the location upstream of the loading station. The conveyor 122 may typically be operated (e.g., by machine controller 200) in a stepped manner so that the buckets are temporarily stopped during loading and unloading.

It is to be clearly understood that the above description is intended by way of illustration and example only, is not intended to be taken by way of limitation, and that other changes and modifications are possible. For example, although a tool-free adjustment mechanism in the form a clamp assembly is primarily described, other tool-free adjustment mechanisms could be used, and mechanisms that require some tool use could also be used. Moreover, while the above description focuses on the leading end wall being position adjustable and the trailing end wall being pivotable, embodiments in which the leading end wall is pivotable and the trailing end wall is position adjustable are also possible.

The invention claimed is:

1. A cartoner infeed bucket, comprising:

a bottom wall, a first end wall extending upward from the bottom wall and a second end wall extending upward from the bottom wall and spaced apart from the first end wall to define an item carrying space, the second end wall running substantially parallel to the first end wall;

wherein the second end wall is mounted for adjustable movement along the bottom wall so as to vary a spacing between the first end wall and the second end wall;

an adjustment mechanism mounting the second end wall to the bottom wall, wherein the adjustment mechanism comprises a clamp assembly, wherein the clamp assembly is movable between a closed position to hold the second end wall at a first location with a first spacing from the first end wall and an open position to allow the second end wall to be shifted to a second location with a second spacing from the first end wall.

2. The cartoner infeed bucket of claim 1, wherein the first end wall is pivotably mounted to the bottom wall for movement between an upright position running substantially vertically up from the bottom wall and an angled position running upward and outward from the bottom wall, wherein a magnetic catch assembly is associated with the first end wall to releasably retain the first end wall in the upright position and to releasably retain the first end wall in the angled position.

3. The cartoner infeed assembly of claim 1, wherein the adjustment mechanism (i) comprises a plurality of interengagable projections and openings and/or (ii) is a tool-free adjustment mechanism.

4. A cartoner machine including a conveyor that carries the cartoner infeed bucket of claim 1.

5. A cartoner infeed bucket, comprising:

a bottom wall, a first end wall extending upward from the bottom wall and a second end wall extending upward from the bottom wall and spaced apart from the first end wall to define an item carrying space, the second end wall running substantially parallel to the first end wall;

wherein the second end wall is mounted for adjustable movement along the bottom wall so as to vary a spacing between the first end wall and the second end wall;

an adjustment mechanism mounting the second end wall to the bottom wall, wherein the adjustment mechanism comprises a clamp assembly, wherein the clamp assembly includes a rail having a length extending along the bottom wall in a direction that runs between the first end wall and the second end wall, and a clamp connected to the second end wall, the clamp movable between a closed position in engagement with the rail to hold the second end wall against movement along the length of the rail and an open position in which the clamp releases from the rail sufficient to allow the second end wall to move along the length of the rail.

6. The cartoner infeed bucket of claim 5, wherein the rail includes a plurality of first mating features along at least part of the length, wherein the clamp includes at least one second mating feature configured for engagement with the first mating features.

7. The cartoner infeed bucket of claim 6, wherein the plurality of first mating features comprise slots and/or teeth and the at least one second mating feature comprises a plurality of second mating features formed by slots and/or teeth.

8. The cartoner infeed bucket of claim 6, wherein the clamp is connected to the second end wall via a biasing assembly for holding the clamp in the closed position.

9. The cartoner infeed bucket of claim 8, wherein the biasing assembly comprises at least one magnet for inhibiting movement of the clamp away from the closed position.

10. The cartoner infeed bucket of claim 9, wherein the biasing assembly is a dual biasing assembly that includes at least one further magnet for holding the clamp in the open position.

11. A cartoner infeed bucket, comprising:

a bottom wall, a first end wall extending upward from the bottom wall and a second end wall extending upward from the bottom wall and spaced apart from the first end wall to define an item carrying space, the second end wall running substantially parallel to the first end wall;

wherein the second end wall is mounted for adjustable movement along the bottom wall so as to vary a spacing between the first end wall and the second end wall;

an adjustment mechanism mounting the second end wall to the bottom wall, wherein the adjustment mechanism comprises a clamp assembly, wherein the clamp assembly includes:

a first rail having a length extending along the bottom wall in a direction that runs between the first end wall and the second end wall, a second rail having a length extending along the bottom wall in the direction that runs between the first end wall and the second end wall, a first clamp connected to the second end wall, the first clamp movable between a closed position in engagement with the first rail to hold the second end wall against movement along the length of the first rail and an open position in which the first clamp releases from the first rail sufficient to allow the second end wall to move along the length of the first rail, a second clamp connected to the second end wall, the second clamp movable between a closed position in engagement with the second rail to hold the second end wall against movement along the length of the second rail and an open position in which the second clamp releases from the second rail sufficient to allow the second end wall to move along the length of the second rail.

12. The cartoner infeed bucket of claim 11, wherein the first clamp includes a first actuation surface and the second clamp includes a second actuation surface, wherein manual squeezing of the first actuation surface and the second actuation surface toward each other moves the first clamp from its closed position to its open position and moves the second clamp from its closed position to is open position.

13. A cartoner infeed bucket, comprising:

a bottom wall, a first end wall extending upward from the bottom wall and a second end wall extending upward from the bottom wall and spaced apart from the first end wall to define an item carrying space;

wherein the second end wall is movable along the bottom wall between a plurality of positions for varying a spacing between the first end wall and the second end wall;

an adjustment mechanism mounting the second end wall to the bottom wall, wherein the adjustment mechanism includes a pair of spaced apart grip elements that are configured to be manually squeezed toward each other to enable movement of the second end wall along the bottom wall.

14. A cartoner machine including a conveyor that carries the cartoner infeed bucket of claim 13.

15. A cartoner infeed bucket, comprising:

a bottom wall, a first end wall extending upward from the bottom wall and a second end wall extending upward from the bottom wall and spaced apart from the first end wall to define an item carrying space;

wherein the first end wall is pivotably mounted to the bottom wall for movement between an upright position running substantially vertically up from the bottom wall and an angled position running upward and outward from the bottom wall, wherein a magnetic catch assembly is associated with the first end wall to releasably retain the first end wall in the upright position and to releasably retain the first end wall in the angled position.

16. The cartoner infeed assembly of claim 15, wherein the magnetic catch assembly includes:

an actuator arm connected to the first end wall so as to pivot with the first end wall, the actuator arm carrying a first magnet, a second magnet mounted at a location to interact with the first magnet so as to releasably retain the first end wall in the upright position, a third magnet mounted at a location to interact with the first magnet so as to releasably retain the first end wall in the angled position.

17. The cartoner infeed assembly of claim 16, wherein a bracket is mounted at an underside of the bottom wall, the second magnet is mounted to an upper portion of the bracket and the third magnet is mounted to a lower portion of the bracket, and a portion of the actuator arm that carries the first magnet extends within a space between the second magnet and the third magnet.

18. The cartoner infeed assembly of claim 17, wherein the actuator arm includes a lower segment having an associated cam roller configured for interacting with a cam track to shift the end wall between the upright and angled positions.

19. A cartoner machine including a conveyor that carries the cartoner infeed bucket of claim 15.

* * * * *